US006021822A

United States Patent [19]

Izawa et al.

[11] Patent Number: 6,021,822

[45] Date of Patent: Feb. 8, 2000

[54] METHOD OF FILLING HOLLOW FIBER WITH GEL

[75] Inventors: Hajime Izawa; Togi Suzuki, both of Ibaraki, Japan, .

[73] Assignee: Teijin Limited, Osaka, Japan

[21] Appl. No.: 08/983,484

[22] PCT Filed: May 20, 1997

[86] PCT No.: PCT/JP97/01689

§ 371 Date: Jan. 22, 1998

§ 102(e) Date: Jan. 22, 1998

[87] PCT Pub. No.: WO97/45583

PCT Pub. Date: Dec. 4, 1997

[30] Foreign Application Priority Data

May 24, 1996 [JP] Japan ..... 8-129864
Sep. 4, 1996 [JP] Japan ..... 8-252242

[51] Int. Cl.[7] ..... D06M 15/00; D01F 1/08

[52] U.S. Cl. ..... 141/110; 141/1; 141/82; 141/13; 8/115.51

[58] Field of Search ..... 141/1, 13, 82, 141/110; 8/115.51

[56] References Cited

U.S. PATENT DOCUMENTS 3,875,008 4/1975 Yoshino et al. ..... 195/63
5,160,627 11/1992 Cussler et al. ..... 210/639
5,505,773 4/1996 Vitands et al. ..... 106/272
5,596,988 1/1997 Markle et al. ..... 128/635

FOREIGN PATENT DOCUMENTS 5339878 12/1993 Japan .
6017372 1/1994 Japan .
6158552 6/1994 Japan .
7026466 1/1995 Japan .
WO 97/45583 12/1997 WIPO .

*Primary Examiner*—J. Casimer Jacyna
*Attorney, Agent, or Firm*—Foley & Lardner

[57] ABSTRACT

This invention provides a method for filling a hollow portion of a hollow fiber with a gel without requiring special equipment such as pressure resistant facilities and enabling an industrial mass production, which comprises immersing said hollow fiber on the surface of which pores are diffusely distributed to communicate to said hollow portion in a gelable liquid, leaving said hollow fiber at room temperature so that said gelable liquid may be absorbed through said pores into the hollow portion, and finally causing thus absorbed gelable liquid gelled.

10 Claims, 3 Drawing Sheets

METHOD OF FILLING HOLLOW FIBER WITH GEL

DETAILED DESCRIPTION OF THE INVENTION

1. Technical Field

The present invention relates to a process for filling a hollow portion of a hollow fiber with a gel easily and in an efficient manner more particularly to a process for filling a hollow fiber with a gel without requiring special equipment such as pressure resistant facilities, and with enabling an industrial mass production.

2. Background Art

There have been a number of proposals to offer methods of encapsulating substances such as active drugs into the hollow portion of a hollow fiber on the surface of which pores are diffusely distributed to communicate to said hollow portion.

For example, Japanese unexamined patent 5-339878, Japanese unexamined patent 6-17372 disclose a procedure by which a solution of a natural protein is allowed to absorb into the hollow portion of a hollow fiber on the surface of which pores are distributed to communicate to said hollow portion, and the protein is subject to a cross-linking treatment to be insoluble, thereby to improve the durability of a moisture absorbing ability of the fiber.

However, generally speaking, as a solution of a natural protein is highly viscous, it is difficult to absorb it through the pores into the hollow portion. On the contrary, if the solution is allowed to have a low concentration so that its viscosity may be lowered, the content of the natural protein present in the hollow portion will be so much reduced that the level of moisture absorbing ability will become inadequately low.

Further, Japanese unexamined patent 7-26466 discloses a procedure in which a hollow fiber composed of a single polymer and having a hollowness ratio of at least 20% is subject to an alkali treatment so as to reduce its weight and to generate micro grooves thereby which communicate to the hollow portion, and an agent which impart a functional property to the hollow fiber is absorbed through these micro grooves into the hollow portion.

However, with above method, as the agent which has been absorbed into the hollow portion is not solidified thereto as, for example, gelling, it will be easily lost during washing, and the function imparted by that agent will become progressively reduced in level over time.

On the other hand, Japanese unexamined patent 6-158552 discloses a method in which a substrate of a porous hollow fiber is passed through a tank containing a mixture in the form of sol the substrate is removed therefrom, and is kept under a reduced pressure so that the sol may be absorb into the hollow portion, and then the assembly is dried under the reduced pressure so that the sol may turn into a gel.

However, with the above method, as the substrate is kept under a reduced pressure when the sol is absorbed into the hollow portion of the hollow fiber, the method can not be applied to a sol which contains a substance which easily turns into vapor such as water. Furthermore, this method requires pressure resistant facilities because it uses a reduced pressure. Thus, to increase production, it is necessary to enlarge the production unit or to introduce a lot of the production units, which makes this method inadequate for mass production.

DISCLOSURE OF INVENTION

The object of this invention is to provide a method of encapsulating a gel into the hollow portion of a hollow fiber in the manner suitable for mass production, without requiring special equipment such as pressure resistant facilities, in order to impart various functions to that fiber by the encapsulating.

The present inventors have strenuously studied to meet the above object, found that, when a hollow fiber on the surface of which pores a diffusely distributed to communicate with the hollow portion is placed in a liquid capable of turning into a gel and is left at room temperature, the liquid is absorbed through the communicating pores into the hollow portion until it fills that portion, and thus achieved this invention.

Namely, this invention is a process for filling a hollow portion of a hollow fiber with a gel, which comprises immersing said hollow fiber on the surface of which pores are diffusely distributed to communicate to said hollow portion in a gelable liquid, leaving said hollow fiber at room temperature so that said gelable liquid may be absorbed through said pores into the hollow portion, and finally causing thus absorbed gelable liquid gelled.

BEST MODE FOR CARRYING OUT THE INVENTION

The hollow fiber to be used in this invention includes, as appropriate, man-made fibers made of rayon, acetate, etc., and synthetic fibers made of polyester, polyamide, etc. Further, these fibers may contain a stabilizer, anti-oxidant agent, flame-retardant agent, anti-static agent, fluorescent whiteness enhancer, catalyst, anti-coloring agent, heat resistant agent, coloring agent, inorganic particles, etc.

The above hollow fiber can be produced by any publicly known techniques, for example, by the method described in examined Japanese Utility Model 2-43879 as needed. The hollowness ratio of the hollow fiber is preferably 5–40%, more preferably 20–40% because such hollowness ratio helps to maintain the necessary properties of a fiber, and allows the introduction of a sufficient amount of a gel.

The method by which to produce communicating pores from the surface of a fiber to its hollow portion includes, for example, a method that, when the fiber is made of a polyester, the polyester is mixed with another polyester copolymerized with organic sulfonic acid compounds, is shaped into a hollow fiber by melt-spinning and submitted to an alkali weight-reducing treatment, thereby to produce multiple communicating pores (minute pores) in the fiber (Japanese unexamined Patent 1-20319 and others).

The method, in which a polyester hollow fiber to which a metal salt of an organic sulfonic acid has been added is submitted to an alkali weight-reducing treatment, thereby to produce multiple communicating pores (minute pores) leading from the surface to the hollow portion, can be also employed (Japanese examined Patent 61-60188 and 61-31231).

Further, by submitting a hollow fiber with a hollowness ratio of 20% or more to an alkali weight-reducing treatment, it is possible to produce multiple communicating pores (micro-grooves) in the substance of fiber as traces of the reduction at the sites of, along the long axis of fiber, portions of low orientation and/or portions of transportation-strain concentration portions, without resorting to a salt of an organic sulfonic acid as described above. (Japanese unexamined Patent 7-26466).

Figure 1:
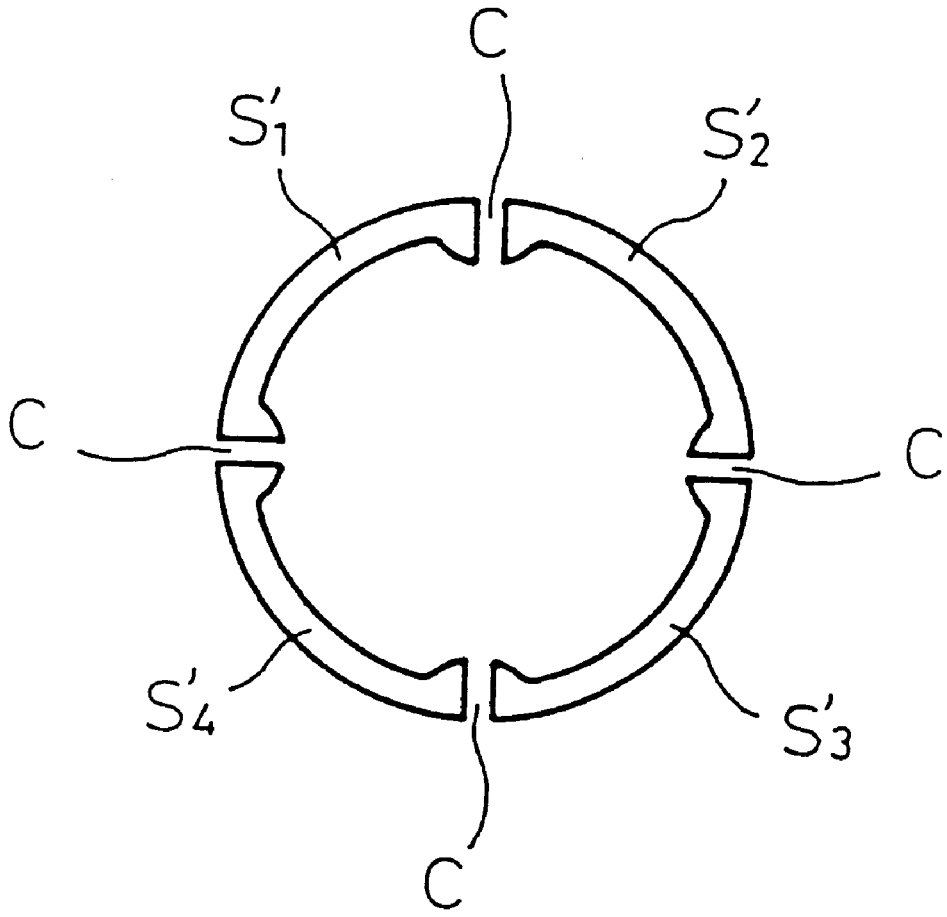
FIG. 1 gives a cross-section of one example of a nozzle which is used for the production of a hollow fiber.
Figure 2:
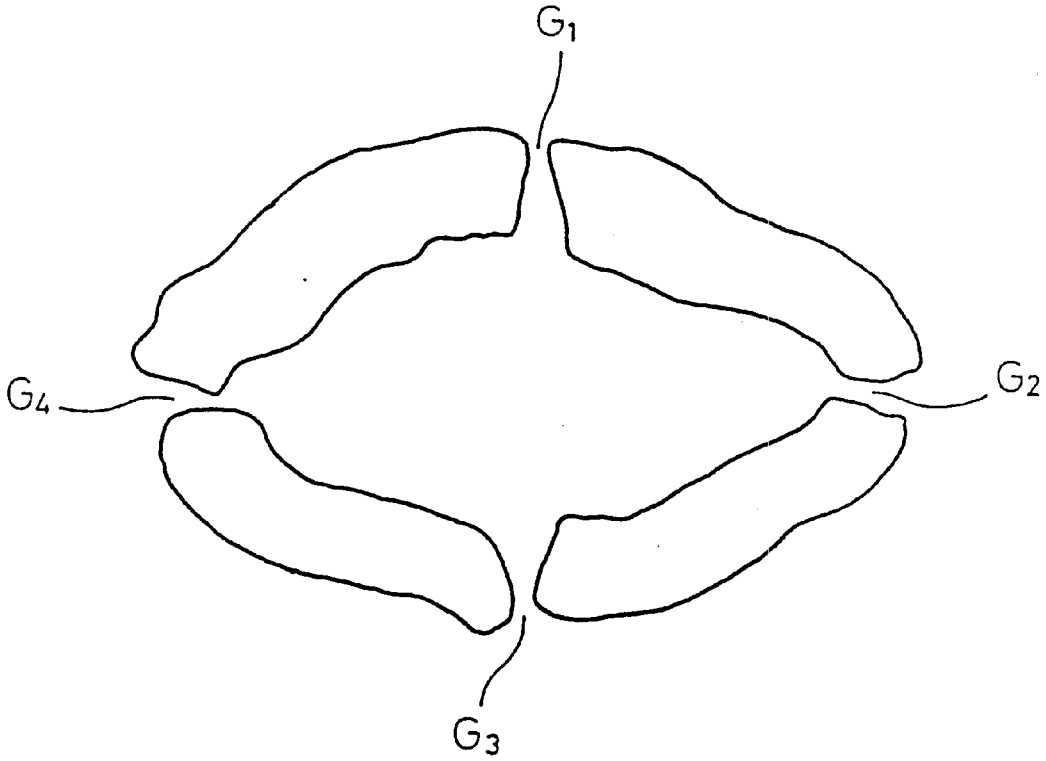
FIG. 2 gives a cross-section of a hollow fiber of which communicating pores have been formed from the surface of the fiber to the hollow portion.

To be more specific, such hollow fiber can be obtained by the use of a nozzle for spinning which is provided with assembly of a plurality of slit-like slots $S_1'$–$S_4'$ as shown in FIG. 1. There are thin openings C (which are called canals) between the edges of adjacent slots, and polymer segments ejected from individual slots are bonded together at these spots by the Baras effect. Then, when the resulting hollow fiber, for example, a polyester hollow fiber is submitted to an alkali weight-reducing treatment, communicating pores $G_1$–$G_4$ are produced as shown in FIG. 2. These pores are preferentially formed by dissolution through alkali weight-reduction treatment at sites where the thin sheath is thinner than their surrounds because of irregularities in ejected mass when polymer is ejected from the slots $S_1'$–$S_4'$ as shown in FIG. 1, where molecular orientation takes place more sparingly than their adjacent sheaths because of impaired fluidity of polymer after it has been ejected from the slots which may possibly arise as a result of irregularities of cooling after ejection, or where transportation-strains are latent which may result from stresses which have been produced in the direction perpendicular to the long axis of the fiber during spinning, drawing and weaving processes.

Furthermore, the procedure (Japanese unexamined Patent 6-17316) whereby a core-sheath fiber is submitted to an alkali weight-reducing treatment so that the core polymer may be dissolved and removed, to produce pores (longitudinal grooves) which lead from the surface to the hollow portion along the long axes of the fiber can be also employed.

The alkali weight-reducing treatment may take place as is commonly performed, but when it is allowed to take place more drastically than usual, the density of slits can be appropriately adjusted. To achieve the latter, an aqueous solution of an alkali such as sodium hydroxide or potassium hydroxide preferably has a concentration of 40–250 g/l, and the fiber is preferably subject to the treatment at 80–140° C. for 2–60 minutes. To achieve alkali weight reduction, any publicly known techniques may be employed as appropriate such as hanging a fiber in an alkali solution, exposing a fiber to a cold alkali solution, exposing a fiber to a flowing alkali solution using a flow-dying machine, exposing a fiber to alkali steam or heated alkali vapor for continuous weight-reduction, etc.

For the formation of communicating pores, pressurized dying may be applied to the fiber after the alkali weight reduction. The use of a flow-dying machine is particularly preferable when pressurized dying is applied to the fiber, because the use of that machine will necessarily elevate the temperature around the fiber and squeeze the fiber, and both actions enhance each other to bring a favorable effect for the present purpose.

The communicating pore preferably has a width of 0.2–10 $\mu$m and a length of 5–20 $\mu$m. If the communicating pore has a width and length out of above range, the introduction into the pore of a gelable liquid, will be insufficient, or conversely the gel having filled the hollow portion will be lost easily.

The density of the formation of the communicating pores may vary depending on the viscosity of the gelable liquid, to fill the hollow portion, and on the width and length of individual pores, but the pores are preferably found on at least 10% of the number of a single fiber when the surface of the fiber is observed with a scanning electron microscope.

The gelable liquid according to this invention includes a liquid substance which, when exposed to a physical or chemical stimulus or simply left alone for a long time, turns reversibly or irreversibly into a gel.

To be more specific, a liquid of which a monomer, capable of polymerization or cross-linking, and a polymerization initiator have been dissolved, dispersed or emulsified in an appropriate liquid such as water, or a liquid which can reversibly turn from sol to gel and vice versa, such as an aqueous solution of a natural protein like collagen, may be mentioned as a preferred example.

The viscosity of above liquids is preferably not more than 100 centimeter poise, or more preferably not more than 30 centimeter poise. If the viscosity of the liquids exceeds 100 centimeter poise, transfer of the liquid into the hollow portion may be hindered.

The monomer capable of polymerization or of cross-linking reaction includes substances which can be dissolved or dispersed in a liquid such as organic solvents or water, and can polymerize in the presence of a polymerization initiator. It may include, for example, vinyl monomers such as butadiene, acrylonitrile, styrene, vinyl chloride, vinylidene chloride, vinyl acetate, (meth)acrylic acid, (meth) acrylic acid derivatives, di(meth)acrylic acid, di(meth)acrylic acid derivatives, and metal alkoxides such as ethyl silicate which can polymerize in the absence of a polymerization initiator. These monomers may be used alone or in combination with 2 or more.

The polymerization initiator includes, for example, peroxides such as potassium persulfate, ammonium persulfate, hydrogen peroxide, benzoyl peroxide, etc., cerium ammonium salts such as cerium ammonium nitrate, and $\alpha,\alpha'$-azobis-isobutyronitrile.

Further, the natural protein includes, for example, collagen, keratin, sericin, etc.

The liquid may contain an agent which can impart a functional property to a fiber. Such agent includes substances (plant extracts and plant proteins) which are pharmacologically active, or give a plant fragrance such as an extract from aloe, kudzu root or garlic, substances (animal proteins) which will give a medically or physiologically important function in bacterial cultivation or wound healing such as collagen, keratin, sericin, etc., substances (ceramic particles) such as titanium oxide, silica, alumina, zeolite, etc., which will give an electrical function for an electric conductor or a magnetic product, substances which has an anti-bacterial activity or deodorant activity such as octacarbo-ferrophthalocyanin, dimethyl phthalate, organic silicon compound quaternary ammonium salts, organic nitrogen compounds etc., various scent givers (flavors and fragrances), substances which, such as a polyethylene glycol, have water absorbing, moisture absorbing or moisture retaining properties, and substances which, such as compounds having perfluoroalkyl group, have water-repellent or oil-repellent properties.

To fill the gelable liquid through the communicating pores into the hollow portion of a hollow fiber, a method is employed which consists of immersing the hollow fiber in that liquid, then squeezing it under a pressure if necessary, and leaving it alone at room temperature.

It is well known that when a liquid flows through a round tube, if the Reynolds number of the liquid is sufficiently small, the pressure loss is expressed by the Hagen-Poiseuille equation (1):

$$\Delta P=8\ \eta\ lu/r^2 \quad (1)$$

where ΔP represents the pressure loss, η the viscosity of the flowing liquid, l the length of liquid which moves through the interior of the round tube, and r the internal radius of the round tube.

As u in the equation (1) represents the length of liquid moving over a fractional time, it can be expressed by dl/dt when t is taken as representing time. When u is substituted by dl/dt, and the equation is integrated, the following equation (2) is obtained.

$$t=4\ \eta\ l^2/(\Delta P r^2) \quad (2)$$

It is understood from the equation (2) that the time necessary for a gelable liquid, to completely transfer into the hollow portion of a hollow fiber is proportional to the viscosity of that liquid and to the square of the length of a communicating pore, and is inversely proportional to the square of the internal radius of the hollow fiber.

It is understood therefore that a hollow fiber on the surface of which pores are diffusely distributed to communicate with its hollow portion requires a far less time for a gelable liquid, to completely transfer into the hollow portion as compared with other similar hollow fibers which have, however, no such communicating pores.

This suggests that, when the density of communicating pores is properly chosen, even a gelable liquid with a comparatively high viscosity (the upper limit of viscosity is 100 centimeter poise) can completely transfer into the hollow portion of a hollow fiber with a considerably small internal radius (the lower limit of internal radius is 4 μm) in a reasonably practical period (the upper limit is 12 days).

After a gelable liquid has been absorbed into the hollow portion of a hollow fiber by the above method, the liquid is turned into gel by, for example, heating, and thereby encapsulation of the gel in the hollow portion of the hollow fiber is completed.

As seen from above, as this invention does not require the use of special equipment such as pressure resistant facilities, it enables a mass production, and is very advantageous for industrial applications.

Figure 3:
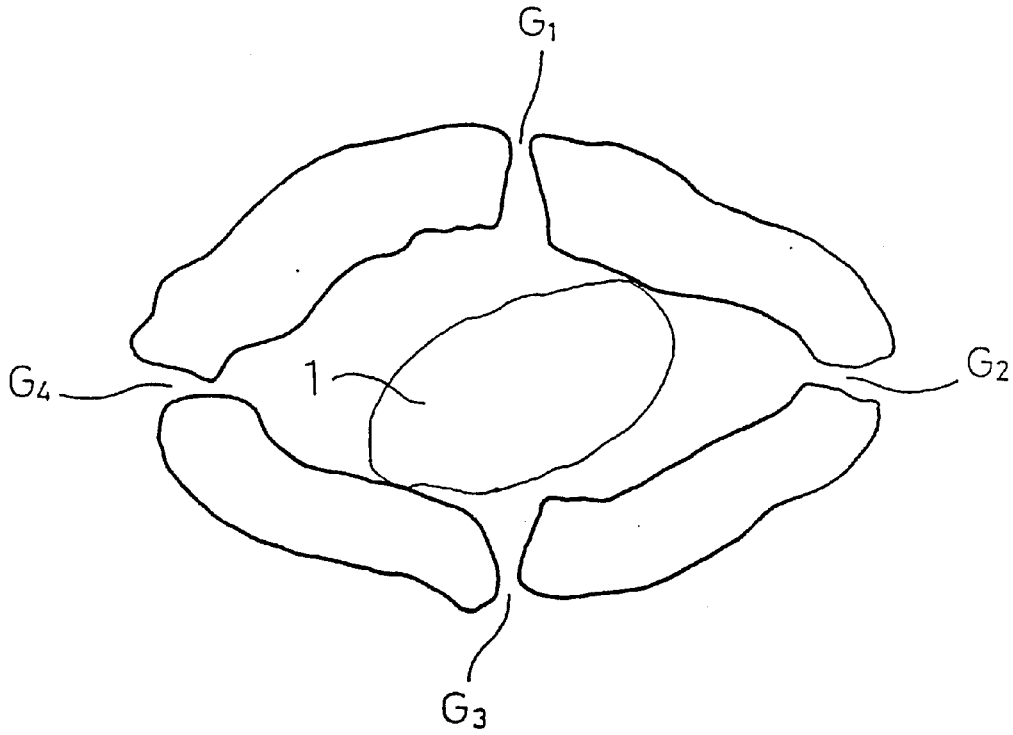
FIG. 3 gives a cross-section of a hollow fiber, in the hollow portion of which gel has been encapsulated by the method of this invention.

FIG. 3 gives a cross-section of a hollow fiber into the hollow portion of which gel is encapsulated by the method of this invention. Namely, gel 1 is encapsulated in the hollow portion of a hollow fiber. The gel 1 is produced after a gelable liquid has been introduced from the surface of the fiber through communicating pores $G_1$–$G_4$ into the hollow portion, and then the liquid has been turned into gel.

For a hollow fiber to be immersed in such liquid, it may take any form such as filament yarn, spun yarn, woven fabric, knitted fabric or nonwoven fabric, but usually it preferably takes the form of a fabric such as woven or knitted fabric because such form improves workability.

In the above method, the transference of a gelable liquid through communicating pores into the hollow portion takes place while the fiber is left alone at room temperature. The room temperature refers here to temperatures prevalent in common work places over a year, more specifically to temperatures with a range of 0–50° C. Out of this range, temperatures under which the liquid starts to turn into gel, before it completely transfers into the hollow portion of the fiber, must be excluded. The period during which the fiber is kept in the liquid is preferably at longest 12 days. If that period exceeds 12 days, the liquid gains such a large viscosity through gelling that transference of the liquid into the hollow portion may be hindered.

For a gelable liquid, to efficiently transfer through communicating pores into the hollow portion of a hollow fiber, it is necessary to adjust as appropriate the size and density of pores, and the viscosity of the liquid, gelling conditions, and the temperature and period at and during which the liquid is left alone.

If the liquid is left alone without a due attention being paid to the kind of the liquid and the temperature at which it is left alone, the liquid will turn into a gel so quickly while it is left alone at room temperature that the transference of the liquid into the hollow portion will become difficult.

To prevent such phenomena, when the gelable liquid, consists of, for example, a monomer suitable for radical polymerization such as (meth)acrylate, (meth)acrylate derivatives, di(meth)acrylate, di(meth)acrylate derivatives, acryl amide, vinyl acetate, styrene, butadiene, etc., an oxygen generate compound such as hydrogen peroxide is preferably added to that liquid so that it may become possible to adjust the speed of gelling.

In this case, oxygen molecules capture activated radicals and transform themselves into the peroxides of those radicals which exist in the reaction system in a metastable manner and only allow the release of radicals at considerably high temperatures. Therefore, such additive adjusts the progression of polymerization reaction at low temperatures to stabilize the liquid, while it allows polymerization to proceed quickly at high temperatures.

The additional amount of the oxygen generating compound is preferably so adjusted as to give oxygen 2–15 mol times, or more preferably 3–7 mol times as much as the amount of radicals, which is inferred on the basis of reaction kinetics, from a polymerization initiator used in combination.

Further, the liquid itself, its solvent or its solutes may vaporize when the liquid is left alone at room temperature, and to prevent such inconvenience it is preferable to seal the assembly with a polyethylene bag or the like as appropriate.

With above method, after the gelable liquid has been introduced into the hollow portion of the fiber, the liquid is allowed to change into gel. However, prior to gelling, it is preferable to treat the hollow fiber in another liquid in which the gelable liquid can be dissolved or dispersed (this may be simply referred to as a treatment hereinafter) so that the gelable liquid adhered onto the surface of the fiber can be removed.

This is because, if the gelable liquid is allowed to remain on the surface of the fiber and to change into gel there, the fiber will harden or the friction resistance of the fiber will increase, and hence textile prepared therefrom will give a coarse feel.

The "treatment" refers to either the procedure in which the hollow fiber is immersed in a bath and a solution such as water filling the bath is agitated, or the procedure in which the hollow fiber itself is agitated in a solution such as water which remains motionless, or the both take place simultaneously.

To the gelable liquid described above may be applied water, acetone, dimethylformamide, dimethylsulfoxide, benzene, toluene, etc. Particularly use of water is preferable because of its low cost and handiness.

It is still more preferable, when the gelable liquid, has been introduced into the hollow portion of the fiber and the assembly is treated with the above liquid, heated to a temperature over the temperature at which the gelable liquid starts to coagulate into gel, because then the gelable liquid, adherent onto the surface of the fiber can be removed at the same time when the gelable liquid introduced into the hollow portion of the fiber coagulates into gel.

It is also possible, on the other hand, to treat the hollow fiber in the liquid kept at a temperature under the temperature at which the gelable liquid starts to coagulate into gel, thereby to dissolve/remove the gelable liquid adherent onto the surface of the fiber, and then to heat the liquid thereby to allow the gelable liquid in the hollow portion of the fiber to coagulate into gel.

Further, it is preferable to add a gelling inhibitor to the liquid, because gelling of the gelable liquid is still more inhibited, and removal of the gelable liquid is still more facilitated therewith.

The gelling inhibitor can generate stable radicals when the gelling proceeds as radical polymerization, and such agents include, for example, diphenylpicrylhydrazyl, galvinoxyl, pherdazyl, etc.; oxygen, sulfur, benzoquinone derivatives, nitro compounds, etc. which generate stable radicals in an addition reaction with growing radicals; and diphenylpicrylhydrazine, diphenylamine, hydroquinone, tertiary butylcatechol, etc. which generate stable radicals in a chain-transfer reaction with growing radicals.

When a liquid containing one of such gelling inhibitors is used to treat a hollow fiber into the hollow portion of which a gelable liquid has been absorbed, the amount of the gelling inhibitor contained in the liquid greatly affects the gelling of the gelable liquid kept within the hollow fiber.

If the amount of gelling inhibitor existent in the liquid is too much, a sufficient amount of gelling inhibitor to interfere with the gelling of gelable liquid will invade through communication pores into the hollow portion, and thus not only the gelable liquid, on the surface of fiber but also the gelable liquid within the fiber will be inhibited of their coagulation activity towards gel. As a result, the gelable liquid may not turn into gel within the hollow fiber.

Accordingly, the content of the gelling inhibitor in the solvent is preferably so adjusted as to give a minimum concentration that can inhibit the gelling of the gelable liquid, adherent onto the surface of the fiber, depending on the gelling inhibiting capability of the gelling inhibitor.

Furthermore, it is also preferable to add a soaping agent to the liquid, because removal of the gelable liquid adherent onto the surface of the fiber will be further facilitated. The soaping agent includes alkali detergents containing sodium hydroxide or sodium carbonate as a main ingredient, ionic surfactants generally used for textile processing, and non-ionic surfactants. The addition of the soaping agent to the liquid is preferably adjusted so as to give a concentration of 0.1–5.0 wt. %.

EXAMPLES

This invention will be described below specifically with reference to examples, but this invention must not be limited to those examples.

(1) Preparation of textiles to be processed

Polyethylene telephthalate with an inherent viscosity of 0.61 was melted, and passed through a nozzle for hollow fiber production, to give an undrawn hollow fiber with a hollowness ratio of 40%. Then, this fiber was drawn into a multi-filament whose constituent fiber has a round hollow portion, and which has a weight of 50 denier/20 filaments (containing 0.3 wt. % of titanium oxide). Its cross-section was photographed under an electronmicroscope, and the internal radius of the hollow fiber was measured to be 8 $\mu$m on average.

These multi-filaments were knitted according to convention into textile (in tricot), scoured and preset (this was called woven textile A).

The textile A was treated for ten minutes in hot water (105° C.) containing 50 g/l of sodium hydroxide so that it might lose its weight by 20% (the resulting cloth was called woven textile B).

The hollow fibers composing the textiles A and B were photographed under the electronmicroscope, and the internal radius was measured. It was found that both textiles gave an average internal radius of 8 $\mu$m. In addition, the textile B was found to be provided with communicating pores diffusely distributed on its surface which pass from the surface to the hollow portion.

(2) Preparation of a liquid potentially having gelling ability

A liquid potentially having gelling ability was prepared according to the following prescription. Said liquid has a viscosity of 6 centimeter poise, will not coagulate into gel at least for ten days when stored at a temperature under 20° C., and will coagulate into gel within two minutes when kept at a temperature over 80° C.

Acrylic acid [15 weight parts]

(containing 200 ppm of methoquinone, and provided by Nippon Shokubai Co., Ltd.)

Sodium hydroxide [7.5 weight parts]

(First class reagent, Wako Pure Chemicals Industries, Ltd.)

Blenmer PDE-400 [1 weight part]

(PEG400 dimethacrylate, NOF Corporation)

Potassium persulfate [0.5 weight part]

(First class reagent, Wako Pure Chemicals Industries, Ltd.)

Water [76 weight parts]

(3) Procedures

The textiles A and B prepared in (1) were immersed in the liquid prepared in (2), and the textiles were squeezed so that it had the liquid adhered by 100%. The textiles were put into a polyethylene bag to be sealed, and the assembly was left in an atmosphere of 20° C.

After a specific period of time, the textiles were removed from the bag, gently rinsed with water of 20° C. so that the extra liquid which had not entered into the hollow portion of the hollow fibers and stayed on their surfaces were removed, and heated at 100° C. for 20 minutes with an ordinary-pressure-steamer.

From the results of inspection of photomicrographs by electronmicroscopy, it was confirmed that, after above treatment, there is practically no remnant gel on the surface of the processed textile, and it can be regarded that the adherence amount of gel to the textile calculated from a weight change of the textile before and after the processing is equal to the encapsulation amount of gel in the hollow portion of hollow fibers.

(4) Evaluation method

The textiles were allowed to be left in an atmosphere of 20° C. for 0 minute, 60 minutes, 6 hours, 24 hours, 3 days, 6 days, and 10 days, and the adherence amount (encapsulation amount, %) of gel observed during each period was calculated from the weight change of the textile before and after the processing.

Example 1

The textile B was submitted to the above gel encapsulation treatment, and the treated textile was found to give a soft feel similar to that of the same textile before the treatment. The adherence amount of gel was as shown in Table 1.

Comparative Example 1

The textile A was submitted to the above gel encapsulation treatment, and the treated textile was found to give a soft feel similar to that of the same textile before the treatment. The adherence amount of gel was as shown in Table 1. Gel was scarcely encapsulated in the hollow portion.

Example 2

The textile B was allowed to be left in an atmosphere of 10° C. in the same manner as described in (3) so that encapsulation of gel might proceed. The treated textile was found to give a soft feel similar to the same textile before the treatment. The adherence amount of gel was as shown in Table 1.

Example 3

The textile B was put to a gel encapsulation treatment which consisted of adding 3 weight parts of 35 wt. % of aqueous solution of hydrogen peroxide to 100 weight parts of a liquid potentially having gelling ability, mentioned in (2), and leaving it in an atmosphere of 50° C., as mentioned in (3). The treated textile was found to give a soft feel similar to that of the same textile before the treatment. The adherence amount of gel was as shown in Table 1.

Comparative example 2

The textile B was allowed to be left in an atmosphere of 55° C. so that encapsulation of gel might proceed. However, gelling started 6 hours later, and entry of gel into the hollow portion scarcely took place.

TABLE 1

| | Example 1 | Comparative Example 1 | Example 2 | Example 3 | Comparative Example 2 |
|---|---|---|---|---|---|
| Knitted textile | B | A | B | B | B |
| Temperature at which textile was left | 20° C. | 20° C. | 10° C. | 50° C. | 55° C. |
| Leaving Period | | | | | |
| 0 minute | 0 | 0 | 0 | 0 | 0 |
| 60 minutes | 1 | 0 | 0 | 1 | 2 |
| 6 hours | 2 | 0 | 1 | 4 | * |
| 24 hours | 6 | 1 | 3 | 9 | — |
| 3 days | 13 | 1 | 6 | 16 | — |
| 6 days | 18 | 2 | 10 | 18 | — |
| 10 days | 18 | 3 | 18 | 18 | — |

*The liquid started to coagulate into gel while being left alone.

INDUSTRIAL APPLICABILITY

This invention, in order to introduce a gel into the hollow portion of a hollow fiber which has communicating pores diffusely distributed which lead from its surface to the hollow portion consists of placing the hollow fiber in a gelable liquid, of squeezing the fiber by pressure as needed, and of allowing the fiber to leave at room temperature. Thus, this invention does not require the use of special equipment such as pressure resistant facilities.

This method, therefore, is very useful for industrial applications in terms of economical and space-saving procedures for the increase of production.

We claim:

1. A process for filling a hollow portion of a hollow fiber with a gel, which comprises:

immersing said hollow fiber on the surface of which pores are diffusely distributed to communicate with said hollow portion in a gelable liquid, leaving said hollow fiber at atmospheric pressure and at a temperature of 0–50° C. so that said gelable liquid may be absorbed through said pores into the hollow portion, and finally causing thus absorbed gelable liquid to gel.

2. The process as claimed in claim 1, wherein the gelable liquid contains a polymerization initiator and a vinyl monomer.

3. The process as claimed in claim 1, wherein the gelable liquid contains a polymerization initiator, an oxygen generating compound and a vinyl monomer.

4. The process as claimed in claim 1, wherein the gelable liquid contains an agent which imparts a functional property to the hollow fiber.

5. The process as claimed in claim 1, wherein the gelable liquid is dissolved in water.

6. The process as claimed in claim 1, wherein the hollow fiber having the absorbed gelable liquid into the hollow portion thereof is treated by a liquid which dissolves or disperses the gelable liquid to remove said gelable liquid on the surface of the hollow fiber prior to causing the gelable liquid to gel.

7. The process as claimed in claim 6, wherein the liquid which dissolves or disperses the gelable liquid is water.

8. The process as claimed in claim 6, wherein the temperature of the liquid which dissolves or disperses the gelable liquid is higher than the temperature at which the gelable liquid is gelled.

9. The process as claimed in claim 6, wherein the liquid which dissolves or disperses the gelable liquid further contains a gelling inhibitor.

10. The process as claimed in claim 6, wherein the liquid which dissolves or disperses the gelable liquid further contains a soaping agent.

* * * * *